United States Patent [19]

Brown et al.

[11] 4,109,852

[45] Aug. 29, 1978

[54] CENTRIFUGAL STRAIN RELIEF SHEATH FOR PROCESSING APPARATUS

[75] Inventors: Richard I. Brown, Northbrook; Daniel R. Boggs, Vernon Hills, both of Ill.

[73] Assignee: Baxter Travenol Laboratories, Inc., Deerfield, Ill.

[21] Appl. No.: 844,225

[22] Filed: Oct. 21, 1977

[51] Int. Cl.[2] ..... B04B 5/02

[52] U.S. Cl. ..... 233/1 R; 233/26

[58] Field of Search ..... 233/1 R, 23 R, 25, 26, 233/27; 64/2 R, 2 P, 4; 74/501 P

[56] References Cited

U.S. PATENT DOCUMENTS

| | | | |
|---|---|---|---|
| 2,000,997 | 5/1935 | Sharpe | 64/2 R |
| 2,893,221 | 7/1959 | Bell | 64/4 |
| 3,885,735 | 5/1975 | Westberg | 233/25 |
| 3,896,442 | 10/1976 | Khoja et al. | 233/25 X |

*Primary Examiner*—George H. Krizmanich

*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment is fixed at one end substantially along the axis of the processing chamber at one side thereof, with the other end of the cable segment being attached substantially on the axis in rotationally locked engagement to the processing chamber. A flexible sheath member is carried by the umbilical cable segment with the flexible sheath member being connected to the axis and having a shank portion which extends from the axis and along a portion of the cable segment. The shank portion of the flexible sheath member has a thickness which decreases along the cable segment in the direction away from the axis. The flexible sheath member provides the umbilical cable segment with a localized stiffness at its anchor points sufficient to allow the umbilical cable segment to withstand high centrifugal forces without fracturing and without requiring other means of lateral support.

10 Claims, 7 Drawing Figures

FIG. 1
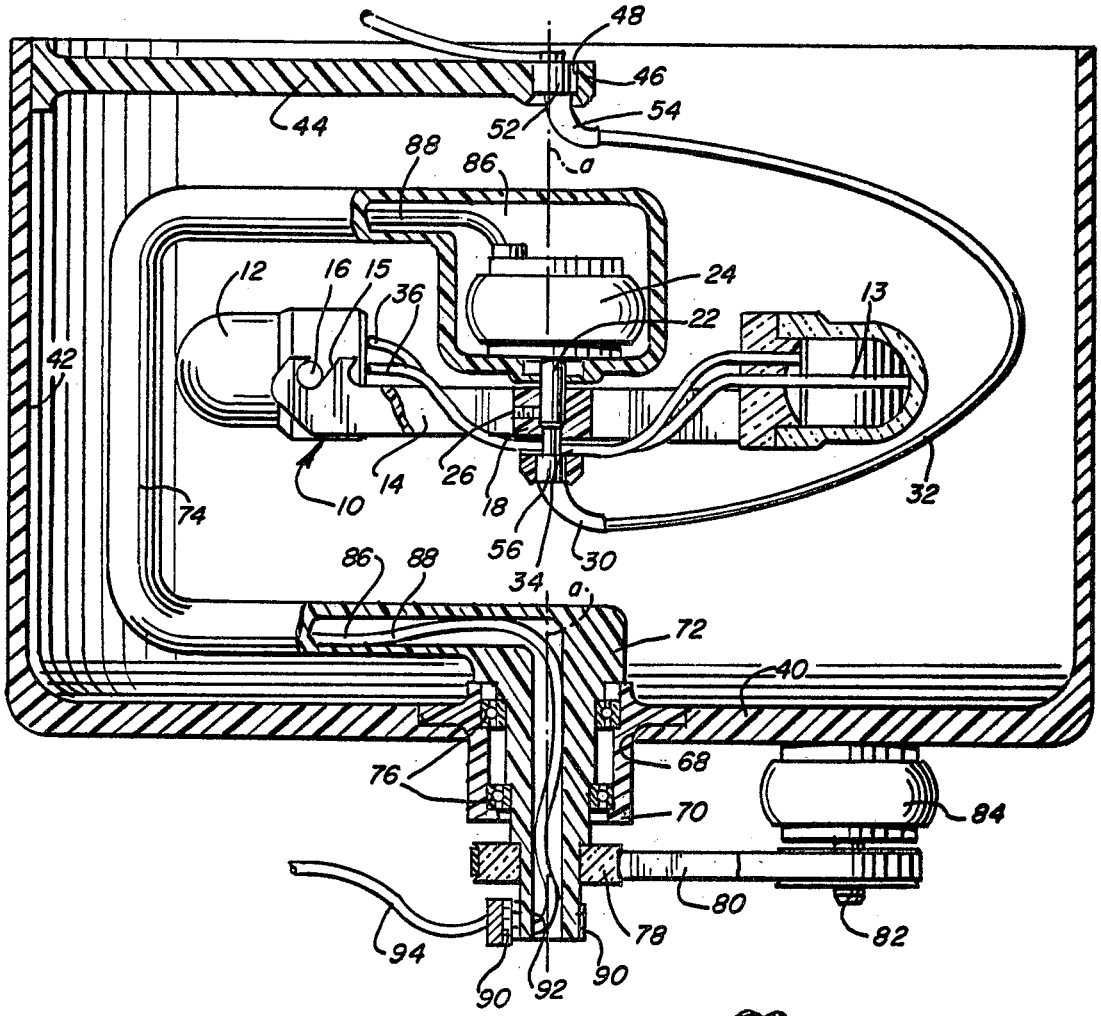
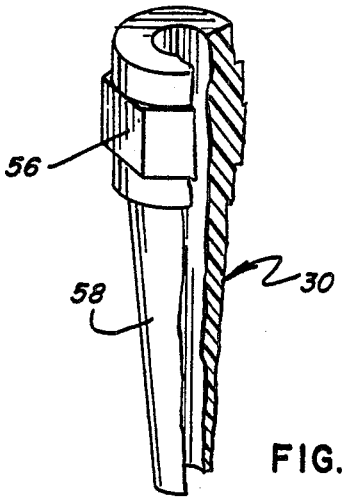
FIG. 2
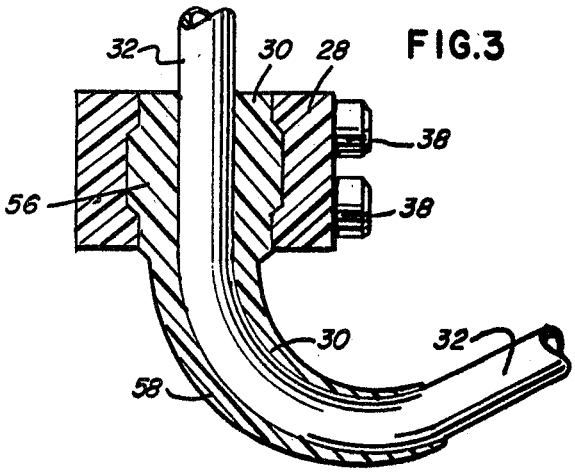
FIG. 3
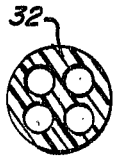
FIG. 4

CENTRIFUGAL STRAIN RELIEF SHEATH FOR PROCESSING APPARATUS

BACKGROUND OF THE INVENTION

The present invention concerns centrifugal processing apparatus and, more particularly, apparatus employing unbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining red blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

A centrifugal processing system has been discovered in which the umbilical cord is connected at its ends to the main axis of the system, but extends freely without being supported or guided by a tube or other guide means. It has been found that there is significant strain at the umbilical tube connection points and for that reason lateral support at the connection points has generally been provided by fairleads or other suitable supporting means. Some lateral supporting means have required lubrication, or bearings or the anchoring system has been found to be relatively expensive. The utilization of a tubular guide arm or the like for the umbilical cord has reduced strain in certain instances, but such guide arm requires additional structural elements which add cost to the system and present a greater possibility of malfunction.

Thus it is desirable to have the ability to use an umbilical cord segment which is connected at its ends to the main axis of the system, but which swings freely during the centrifugal processing operation. It is an object of the present invention to provide means which allow the umbilical cord to withstand high centrifugal forces without fracturing.

Another object of the present invention is to provide the umbilical cord with a localized stiffness at its anchor points.

A still further object of the present invention is to provide centrifugal processing apparatus in which a free-flight type of umbilical cord carries strain relief means which allow the umbilical cord to withstand high centrifugal forces without expensive means of lateral support.

Another object of the invention is to provide strength to the umbilical cord at its anchor points without requiring bearings and/or lubrication systems.

Another object of the present invention is to provide a centrifugal processing apparatus using a free-flight type of umbilical cord segment which is simple in construction and efficient to manufacture.

A further object of the present invention is to provide means to anchor umbilical tubing to the torque arm of centrifugal processing apparatus and also to the processing chamber portion.

Other objects and advantages of the present invention will become apparent as the description proceeds.

BRIEF DESCRIPTION OF THE INVENTION

In accordance with the present invention, centrifugal processing apparatus is provided which comprises a stationary base and a processing chamber rotatably mounted with respect to the base for rotation about a predetermined axis. A flexible umbilical cable segment is provided for establishing communication with the processing chamber. One end of the cable segment is fixed with respect to the base substantially along the axis at one side of the processing chamber. The cable segment extends around the processing chamber with the other end of the cable segment attached substantially on the axis in rotationally locked engagement to the processing chamber.

A flexible sheath member is carried by the umbilical cable segment and is connected to the axis. The flexible sheath member has a shank portion which extends from the axis and along a portion of the cable segment, with the shank portion having a thickness which decreases along the cable segment in the direction away from the axis connection.

In the illustrative embodiment, the flexible sheath defines a central bore through which the cable segment extends. Means are provided for fastening the cable segment to the walls defining the central bore.

In the illustrative embodiment, the flexible sheath member and the cable segment are formed of PVC and the distal end of the flexible sheath member has a thickness that is no greater than 0.012 inch. A first flexible sheath member is carried by the cable segment at one end thereof and is fastened to the torque arm of the centrifugal processing apparatus and a second flexible sheath member is carried by the other end of the cable segment and is fastened to the processing chamber of the centrifugal processing apparatus.

A more detailed explanation of the invention is provided in the following description and claims, and is illustrated in the accompanying drawings.

BRIEF DESCRIPTION OF THE DRAWINGS

FIG. 1 is an elevational view, taken partially in cross-section for clarity, of centrifugal processing apparatus constructed in accordance with one embodiment of the present invention;

FIG. 2 is an elevational view, partially broken for clarity, of a flexible sheath used in connection with the centrifugal processing apparatus of the present invention;

FIG. 3 is a view, taken partially in cross-section, of a two $\omega$ flexible sheath holder constructed in accordance with the principles of the present invention;

FIG. 4 is a cross-sectional view of a cable segment constructed in accordance with the principles of the present invention;

DETAILED DESCRIPTION OF THE ILLUSTRATIVE EMBODIMENTS

Figure 5:
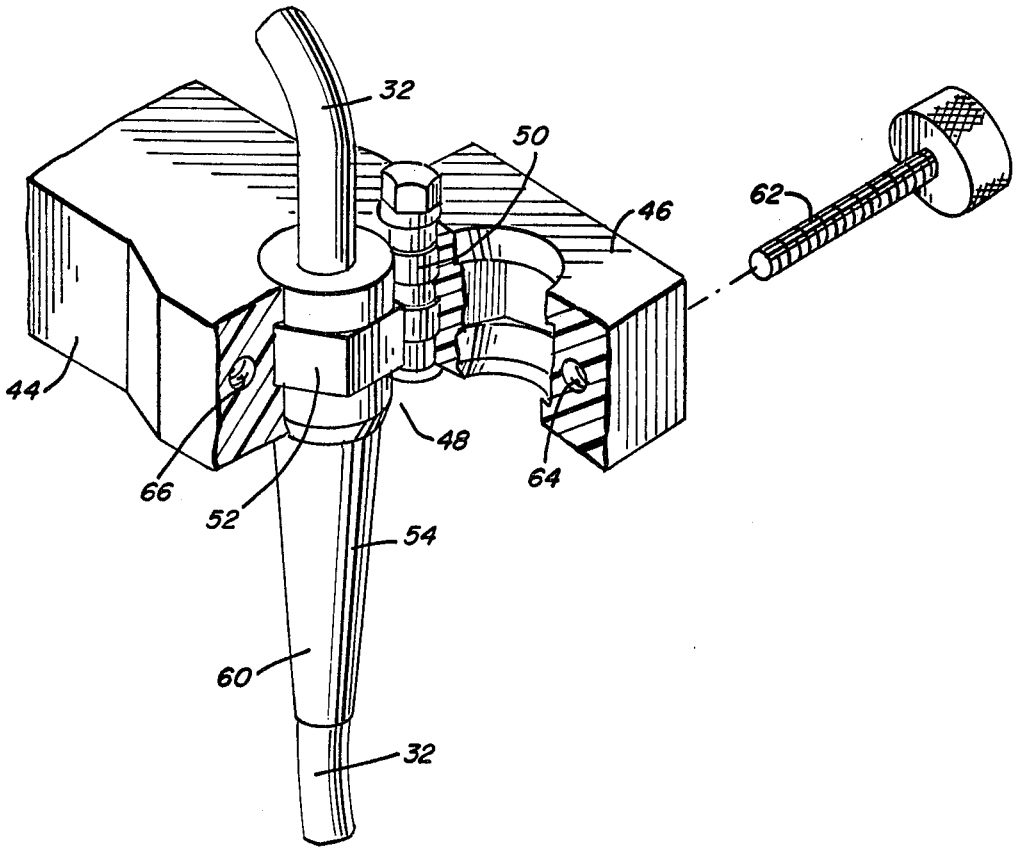
FIG. 5 is a perspective view, with portions broken for clarity, of a flexible sheath and torque arm connector, constructed in accordance with the principles of the present invention.

Referring to the drawings, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 10. Processing chamber 10 includes a pair of buckets 12, 13 which are mounted in diametrically opposed positions. Buckets 12, 13 are mounted on a cradle 14 which is rotatable about a central axis *a*. The opposed ends of cradle 14 define slots 15 into which pins 16 carried by buckets 12, 13 may be connected.

The central portion of cradle 14 defines a ring or hub 18, defining a central axial bore 20 for receiving the shaft 22 of an electric motor 24. Shaft 22 is keyed to hub 18 by a set screw 26 or other suitable fastening means.

Hub 18 carries a sheath holder 28, which sheath holder 28 defines a central bore for receiving a sheath 30 which surrounds a portion of umbilical cable segment 32. Holder 28 defines radial openings 34 for permitting tubes 36, which extend from umbilical cable 32, to pass from cable 32 through openings 34 to buckets 12, 13. While holder 28 is fixed to hub 18, as shown most clearly in FIG. 3, the holder 28 may be hinged and opened by loosening screws 38, thereby permitting release of sheath 30, associated cable segment 32 and tubes 36 from the cradle 14. Thus to remove buckets 12 and 13 and their associated tubes 36 from the assembly, pins 16 are removed from slots 15, screws 38 are loosened to allow sheath 30 and associated cable segment 32 to be removed from holder 28 and hub 18, thereby simply releasing the buckets and cable segment from the drive mechanism without requiring passage of tubing or other elements through a central hollow shaft.

A stationary base 40 is provided, comprising a bowl 42 with a stationary or fixed torque arm 44 connected to a side of the bowl 42 and extending to a position whereby the distal end 46 of torque arm 44 defines an opening 48 that is coaxial with axis *a* to receive a fixed end of cable segment 32. Torque arm 44 is hinged at 50 so as to receive the polygonal base 52 of a flexible sheath 54. Flexible sheath 54 defines a central axial bore which receives cable segment 32 snugly therein. Although not essential, in the illustrative embodiment flexible sheath 30 and flexible sheath 54 are identical, with each comprising a polygonal base 56, 52, respectively, a flexible shank portion 58, 60, respectively, and a central axial bore for snugly receiving cable segment 32.

Flexible sheath 54 is clamped to torque arm 44 by means of the hinged assembly with end 46 swinging about hinge 50 and being secured by a manually graspable bolt 62 which extends through slot 54 and into slot 66 of torque arm 44, thereby grasping base 52 for securement of the flexible sheath to the torque arm. Release of the flexible sheath and its associated cable 32 from the torque arm 44 is readily apparent from FIG. 5.

Thus polygonal base 52 is fastened to axis *a* and polygonal base 56 is also fastened to axis *a*, at different locations along the axis. Shank portions 58 and 60 of the respective flexible sheaths 30 and 54 extend from the axis and along a portion of the cable segment 32, as seen from the drawings. The shank portions have a thickness which decreases along the cable segment in the direction away from the axis.

Figure 6:
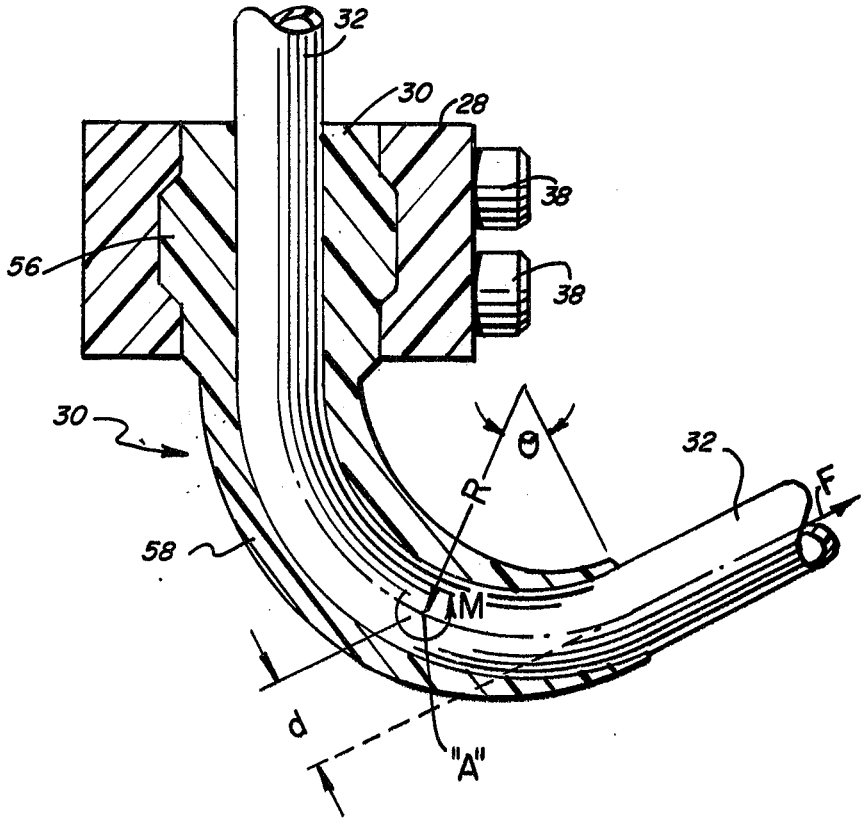
FIG. 6 is a view similar to the view of FIG. 3, but also including a diagram of the letters used with respect to certain formula.

As shown most clearly in FIGS. 3 and 6, the shank portions taper into the periphery of the cable segment 32, with a smooth continuous taper being the preferred structure. The tapered shank portions provide a variable bending stiffness to control the amount of bending that the cable segment 32 undergoes during the direction change transitions at the two anchor points at axis *a*. The tapered cross-sectional dimensions of the flexible sheath members are so designed as to prevent the cable segment from collapsing due to the severe bend radius.

In the illustrative embodiment, the umbilical cable segment used is multi-lumen PVC tubing and the flexible sheaths 30, 54 have been molded in PVC. Polygonal sections 52, 56 are hexagonal in the illustrative embodiment which has been found satisfactory to provide an anti-twist feature.

The physics in connection with the tapered configuration of the flexible sheaths commences with the assumption that the centrifugal field created at 750 rpm (one $\omega$) is an approximate five pound tension force on the cable segment at its ends. Referring to FIG. 6, this tensile force creates a bending moment within the fully loaded flexible sheath of $M = Fd = FR$ (1-cos $\theta$) at an arbitrary point A located at the angle $\theta$ up the sheath from its smallest end. This bending moment increases as $\theta$ increases. Since the example desires a constant cable segment bending radius, R, the sheath cross-sectional dimension or outer radius, $r_s$, must also increase with $\theta$ in accordance with the known function $$1/R = M/EI$$

Where $R$ is the bend radius, $M$ is the bending moment, $E$ is flexural modulus of elasticity and $I$ is the area moment of inertia.

For a circular cross-sectional configuration, $$I = (\pi/2)r_s^4$$

Thus $r_s$, which is the thickness of the sheath from the centerline at a selected point A, is derived as follows:

$$r_s = \sqrt[4]{\frac{2R^2F(1 - \cos\theta)}{\pi E}}$$

In designing the flexible sheath, the type of material, e.g., PVC, is first determined. An arbitrary bending radius R is then selected. Point A is then selected at the smallest $r_s$ (at $\theta = 0$). $F$ is then selected. F is a selected load, considering what force the designer wants the tubing to be able to withstand, e.g., 4 pounds. If a designer wanted the same tube to rotate faster, the F would be a higher number. E, the known flexural modulus for the material, is then applied to the equation for $r_s$ (above), using different $\theta$'s for different points along the length of the shank.

It is to be understood that the above formula is an approximation formula only and that variations in the shape may be designed and used in accordance with the principles of the present invention.

It is preferred that the distal, or smallest, end of the shank portion be as small in thickness as possible, in order for the shank portion to effectively taper into the cable segment. To this end, it is preferred that the distal end of the flexible sheath member have a thickness that is no greater than 0.012 inch.

Figure 7:
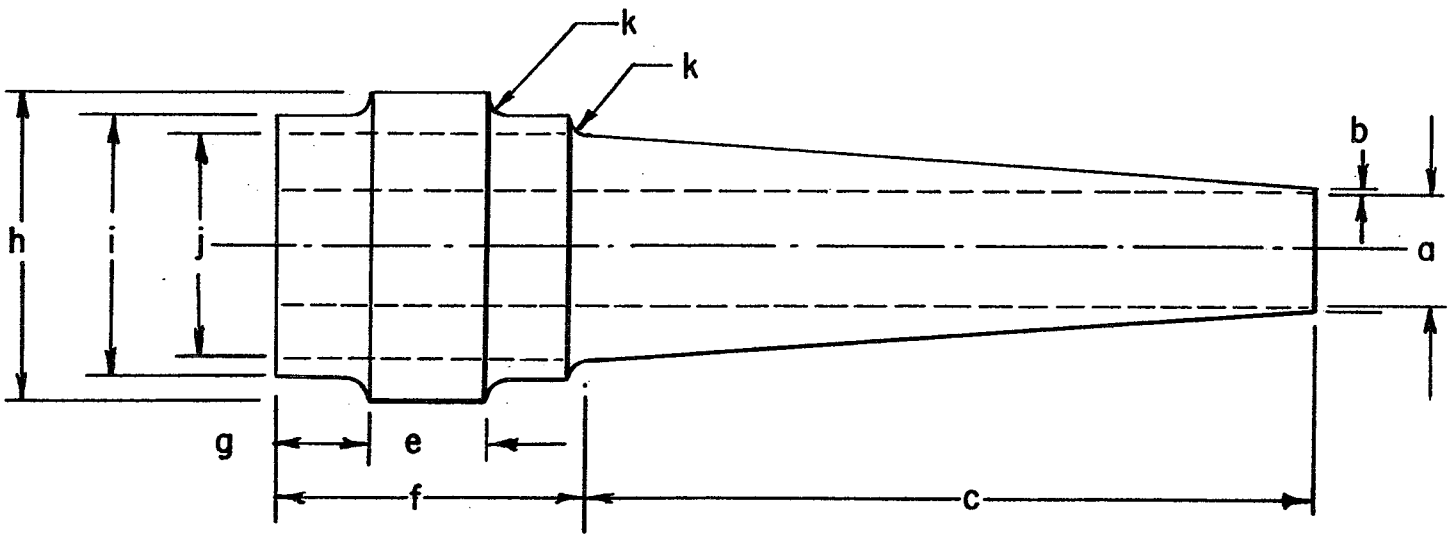
FIG. 7 is a front view of the flexible sheath of FIG. 2.

As a specific example, although no limitation is intended, the following dimensions have been found satisfactory for use with a flexible sheath member (see FIG. 7).

| Reference Letter | Dimension |
|---|---|
| a | 0.365 inch |
| b | 0.010 ± .002 inch |
| c | 2.36 inch |
| e | 0.37 inch |
| f | 1.00 inch |
| g | 0.31 inch |
| h | 1.00 inch |
| i | 0.87 inch |
| j | 0.75 inch |
| k | 1/16 inch radius |

As stated above, flexible sheaths 30, 54 define a central bore through which cable segment 32 extends. The cable segment is preferably rigidly fastened to the walls defining the central bore so that there is no relative movement between the flexible sheath member and the cable segment.

The bottom portion of base 40 defines an opening 68 for receiving a bearing housing 70. Bearing housing 70 surrounds the lower portion 72 of a one $\omega$ turn arm 74, which turn arm 74 is rotatable about axis *a*. Turn arm 74 is coupled to base 40 by a pair of ball bearings 76. A pulley 78 is keyed to lower portion 72 of turn arm 74 and is coupled by belt 80 to the shaft 82 of electric motor 84 which is fixed to base 40. Shaft 82 is set to rotate at one $\omega$ so as to cause one $\omega$ rotation of turn arm 74 about axis *a*.

Turn arm 74 defines a central bore 86 through which electrical wires 88 extend for connection to electric motor 24. Electrical power is transmitted to electrical lines 88 by means of brushes 90 which are electrically connected to electrical line 94 which is coupled to a suitable source of electric energy. During rotation of turn arm 74 and its lower portion 72, brushes 90 will engage terminals 92 to transmit electrical energy via line 94, brushes 90, terminals 92 and line 88 to electrical motor 24.

In order for motor 24 and motor 84 to be speed synchronized, a pair of additional control leads may be coupled from the motor 24 to terminals 92. Two additional brushes 90 are coupled to a tachometer-feedback circuit for providing appropriate feedback information to motor 24 so as to synchronize motor 24 with motor 84. In this manner, shafts 22 and 82 will both have one $\omega$ synchronized rotation.

As used herein, the term "one $\omega$" signifies any rotational velocity and is used as a relative term so that the term "two $\omega$" is used to designate an angular velocity twice the angular velocity of one $\omega$.

Fluid communication with buckets 12 and 13, which rotate as part of processing chamber 10, and with the non-rotating portions of the centrifugal processing system, is provided by the umbilical cable or tubing 32. Cable 32 defines separate passageways or conduits therein, with a cross-sectional configuration of cable 32 being shown in FIG. 4. Although four lumen tubing is preferable, it is to be understood that no limitation with respect to the particular size of the cable or the number of passageways is intended or should be implied. Further, tubing 32 could be circular or polygonal in cross-sectional configuration. Four tubes 36 extend from the four openings defined by four lumen tubing 32, for communication to and from buckets 12 and 13, as discussed above.

Cable 32 is suspended from a point above and axially aligned with processing chamber 10 by means of its fixed connection to torque arm 44 through flexible sheath 54 which acts to relieve the strain. A segment of cable 32 extends downwardly from its axially fixed position, radially outwardly, downwardly and around, and then radially inwardly and upwardly back to the processing chamber 10. The other end of cable 32 is fixed to an axial position by its connection to the holder 28 and it also carries a strain relief sheath 30, similar to strain relief sheath 54.

In the operation of the system, when electric motors 24 and 84 are energized, shafts 22 and 82 will rotate at one $\omega$. The one $\omega$ rotation of shaft 84 will cause turn arm 74 to rotate at one $\omega$ about axis *a*. The one $\omega$ rotation of turn arm 74 about axis *a*, combined with the one $\omega$ rotation of shaft 22 also about axis *a*, will cause two $\omega$ rotation of processing chamber 10. At the same time, cable segment 32 will be rotating at one $\omega$ about axis *a*.

It can be seen that there is no need to pass any portion of the processing chamber 10 or tubing 32 through a hollow central drive shaft. Loading and/or unloading of the system is greatly simplified, in the manner described above.

Although turn arm 74 is shown as a single arm in the illustrative embodiments, in order to enhance the stability of the system it is desirable that appropriate counterbalancing means be used. To this end, turn arm 74 could take the form of three equilateral arms forming a spider-like configuration. Additionally, turn arm 74 could take the form of a half shell or could comprise two opposed arms for balance. It is to be understood that other counterbalancing structural configurations may be employed if desired.

Although an illustrative embodiment of the invention has been shown and described, it is to be understood that various modifications and substitutions may be made by those skilled in the art without departing from the novel spirit and scope of the present invention.

What is claimed is:

1. Centrifugal processing apparatus, including:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber, the improvement comprising, in combination:

a flexible sheath member carried by said umbilical cable segment, means connecting said flexible sheath member to said axis, said flexible sheath member having a shank portion which extends from said axis and along a portion of said cable segment, and said shank portion having a thickness which decreases along said cable segment in the direction away from said connecting means.

2. Centrifugal processing apparatus as described in claim 1, in which said flexible sheath defines a central bore through which said cable segment extends; and means fastening said cable segment to the walls defining said central bore.

3. Centrifugal processing apparatus as described in claim 1, in which said flexible sheath and said cable segment are formed as a unitary, one-piece construction.

4. Centrifugal processing apparatus as described in claim 1, wherein said flexible sheath member and said cable segment are formed of PVC.

5. Centrifugal processing apparatus as described in claim 1, wherein the distal end of said flexible sheath member has a thickness that is no greater than 0.012 inch.

6. Centrifugal processing apparatus as described in claim 1, wherein a first said flexible sheath member is carried by said cable segment at one end thereof and a second said flexible sheath member is carried by said cable segment at its other end.

7. Centrifugal processing apparatus, including:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber, the improvement comprising, in combination:

a flexible sheath member carried by said umbilical cable segment, said flexible sheath member defining a central bore through which said cable segment extends;

means fastening said cable segment to the walls defining said central bore;

means connecting said flexible sheath member to said axis;

said flexible sheath member having a shank portion which extends from said axis and along a portion of said cable segment, said shank portion having a thickness which decreases along said cable segment in the direction away from said connecting means, the distal end of said flexible sheath member having a thickness that is no greater than 0.012 inch; and a first said flexible sheath member being carried by said cable segment at one end thereof and a second said flexible sheath member being carried by said cable segment at its other end.

8. Centrifugal processing apparatus, including:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the processing chamber, the improvement comprising, in combination:

said cable segment having a strain relief portion located adjacent said axis;

means connecting said strain relief portion to said axis;

said strain relief portion being formed of flexible material and having a thickness which decreases along said cable segment in the direction away from said connecting means, tapering into the periphery of the remaining portion of said cable segment.

9. Centrifugal processing apparatus as described in claim 8, said strain relief portion comprising a flexible sheath member defining a central bore through which said cable segment extends; and means fastening said cable segment to the walls defining said central bore.

10. Centrifugal processing apparatus as described in claim 9, wherein the distal end of said flexible sheath member has a thickness that is no greater than 0.012 inch.

* * * * *